United States Patent [19]

Biesheuvel et al.

[11] Patent Number: 4,664,750

[45] Date of Patent: May 12, 1987

[54] METHOD FOR COKE QUENCHING CONTROL

[75] Inventors: Adrian A. Biesheuvel, Heerhugowaard; Rudolf F. van Luik, Zandvoort; Rudolf H. Meijer, Assendelft, all of Netherlands

[73] Assignee: Estel Hoogovens B.V., Ijmuiden, Netherlands

[21] Appl. No.: 188,070

[22] Filed: Sep. 17, 1980

[30] Foreign Application Priority Data

Sep. 18, 1979 [NL] Netherlands ..... 7906929

[51] Int. Cl.[4] ..... C10B 21/12; C10B 39/08

[52] U.S. Cl. ..... 201/1; 201/39; 202/151; 202/227; 202/270

[58] Field of Search ..... 201/1, 39, 41; 202/151, 202/227, 230, 270

[56] References Cited

U.S. PATENT DOCUMENTS

| | | | |
|---|---|---|---|
| 2,837,470 | 6/1958 | Hayden | 202/227 |
| 2,876,172 | 3/1959 | Haberle | 201/1 |
| 3,580,813 | 5/1971 | Hinchliffe | 202/230 |
| 3,607,660 | 9/1971 | Kvmper | 201/1 |
| 3,812,018 | 5/1974 | Hinchliffe | 202/230 |
| 3,876,143 | 4/1975 | Rossow et al. | 202/227 |
| 4,045,292 | 8/1977 | Matsushita et al. | 201/1 |

FOREIGN PATENT DOCUMENTS

| | | | |
|---|---|---|---|
| 1903803 | 8/1970 | Fed. Rep. of Germany | 201/1 |
| 0600164 | 4/1978 | U.S.S.R. | 202/227 |
| 0621719 | 8/1978 | U.S.S.R. | 201/1 |
| 0700530 | 12/1979 | U.S.S.R. | 201/1 |
| 0700532 | 12/1979 | U.S.S.R. | 201/1 |

*Primary Examiner*—Barry S. Richman
*Assistant Examiner*—Joye L. Woodard
*Attorney, Agent, or Firm*—Nils H. Ljungman

[57] ABSTRACT

Hot coke 3 expelled from a coking chamber is conveyed in a quenching car 2 to a quenching tower 4 past an infra-red detector 6 which provides a signal to initiate supply of the quenching water. It is a problem to control the amount of quenching water supplied to achieve adequate quenching without adding excess humidity. To solve this, the detector produces an analogue signal dependent on the surface temperature of the passing coke, and the duration of supply of quenching water is determined from this signal. The signal may also be used to control variation of the degree of quenching at different parts of the car and also to control the heating of the coking chamber.

3 Claims, 2 Drawing Figures

METHOD FOR COKE QUENCHING CONTROL

BACKGROUND OF THE INVENTION

1. Field of the Invention

The invention relates to a method for the production of coke by dry distillation of coal.

2. Description of the Prior Art

Conventionally, coal is dry-distilled in a vertical coke chamber and the coke obtained is expelled into a quenching car, after which the car is run beneath a coke quenching tower. It is known for a signal transmitted by an infra-red detector passed by the car on its way to the quenching tower to be used to initiate the supply of quenching water. This infrared detector is connected as an on/off detector, and the spray system in the coke quenching tower starts to spray when the detector signals passage of the glowing coke in the quenching car.

Spray installations are generally designed to produce a constant quantity of quenching water per unit of time through each of the sprays. The quenching installation is therefore arranged to supply quenching water for a constant quenching period, which period is adjusted according to the anticipated maximum temperature arising in the coke and the thickness of the coke layer in the car. This prevents the presence in the car of any coke residue still glowing after quenching, which could lead to afterburning of the coke after the coke has been emptied onto a quenching chute. One consequence of this method is that in every case where the average temperature of the coke in the quenching car is lower than the highest temperature arising the humidity of the coke becomes too high. Furthermore, overlengthy quenching times can reduce the availability of the quenching tower.

SUMMARY OF THE INVENTION

The object of the present invention is therefore to provide a method of production of coke in which the amount of quenching water supplied is adapted to the particular load of coke on the quenching car.

A further object of the invention is to provide for control of the heating of the coking chamber in dependence on the temperature of the coke produced.

The essence of the invention is that the detector is used to produce an analogue measurement signal of the surface temperature of the coke in the quenching car, this signal being used to adjust the quenching time required. It has been found that an infra-red detector can easily be used to obtain an analogue measurement signal which provides a sufficiently reliable reproduction of the surface temperature of the coke throughout the length of the quenching car. Thus the detector is used not only for switching the spray system on and off but the strength of the signal measured determines the quenching time per passing quenching car.

By the term "analogue signal" we mean that the signal comprises quantitative information as to the surface temperature detected. The actual form of the signal, which will typically be electrical, may of course be digital.

A simple method of performing the invention is for the maximum temperature of coke in the quenching car to be obtained from the measured signal by electronic means in a manner which is in itself known, this maximum temperature then being used for setting the required quenching time. However, the temperature range of the coke in the car could, as measured, vary widely. Preferably, therefore variation in the said analogue signal along the length of the quenching car as the car passes the detector is used to determine the desired durations of quenching water supply at a plurality of different locations along the quenching car.

It goes without saying that, in this case, the quenching system adopted must be so designed that the quenching time is adjustable individually for each spray or section of sprays in the system.

Thus the invention makes it possible for the quenching time to be more adequately adjusted to the requirements of each load of coke on a quenching car, and in this way an unnecessarily high humidity in the coke can be avoided. It should be noted that when a blast furnace is charged with coke, it is important that the humidity in the coke should not be too high for the efficient operation of the furnace. It should further be noted that a saving in quenching time can lead to an extension in the availability of the quenching tower and therefore to a reduction in the cycle time of a coke quenching car.

It has already been mentioned that in the practice of the invention, the quenching times of individual sprays or of sections of sprays can be adjusted on the basis of the temperature variations measured in the quenching car. It will however be clear that simpler operation is possible if the temperature of the coke in the quenching car is kept as uniform as possible. It is also important for optimum operation that the average temperature of the coke in the quenching car should be as uniform as possible from one car load to the next. This means that the temperature of operation from coke chamber to coke chamber and within each coke chamber should be kept as uniform as possible.

The average temperature and the temperature distribution in a coke chamber depend partly on the setting of the burners in the combustion chambers between the coke chambers. Attempts have already been made to set the temperature and the temperature distribution in coke chambers more accurately by measuring temperatures in the chambers. For example it has been proposed to measure the temperature at various points in each coke chamber using infra-red detectors after the chamber has been emptied, and to adjust the setting of the burners on the basis of this measurement. It is also customary for the temperature of each burner to be measured directly via the sight holes on the surface of the furnace, to obtain an impression of the temperature and temperature distribution along the wall of the coke chamber. It has been found that neither method can be regarded as viable on ergonomic grounds, and neither has proved to be sufficiently accurate in practice to provide a reliable measurement. Furthermore, measurement through the sightholes is very time-consuming.

We have now found that the signal measured by the infra-red detector close to the quenching tower can also be used as a derived measurement of the temperature along the coke chamber wall. One aspect of the invention is therefore that the signal from the infra-red detector is used for adjusting the temperature distribution along the walls of the coke chamber. It has even been found possible for local differences in the heating of the coke chamber to be determined and adjusted on the basis of variations in the analogue measurement signal from the infra-red detector along the length of the coke quenching car.

It should be noted that, commonly, the coke in the quenching car is still burning before it is quenched in the quenching tower. It is then important that the flame produced by the coke should not distort the measurement signal. This can be avoided by setting the infra-red detector to detect only the wavelength of the glowing coke.

BRIEF DESCRIPTION OF THE DRAWINGS

The preferred embodiment of the invention will now be described by way of non-limitative example with reference to the accompanying drawing, in which.

DESCRIPTION OF THE PREFERRED EMBODIMENT

Figure 1:
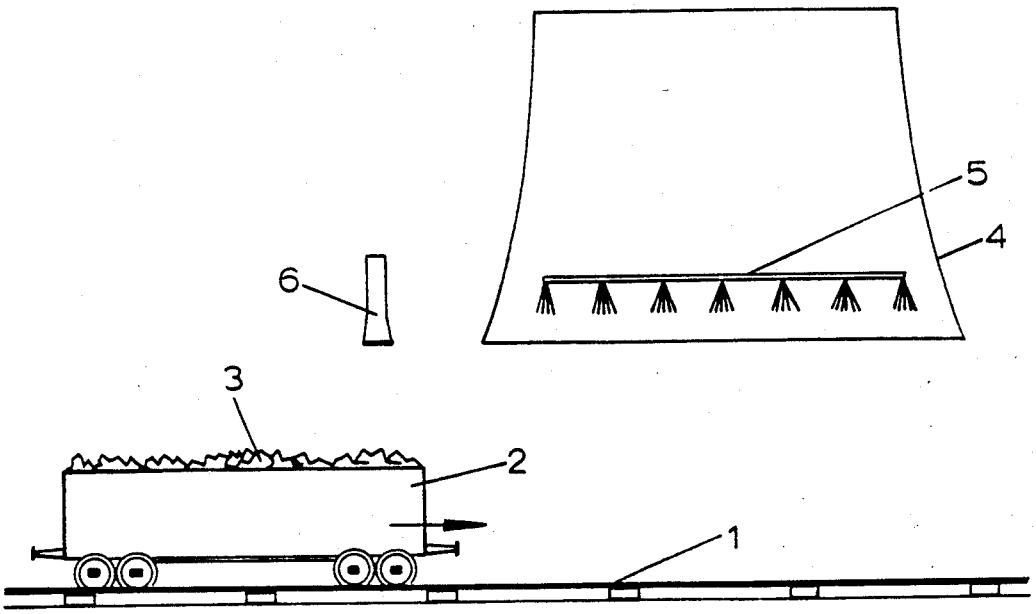
FIG. 1 shows schematically parts of a coking plant, in particular the location of an infra-red detector near a quenching tower.

In FIG. 1, there is shown a track 1 along which a coke quenching car 2 travels in the direction of the arrow to arrive underneath a quenching tower 4. The quenching car 2 is filled with glowing coke 3 expelled from a conventional coke oven (not shown). There is a spray system 5 in the tower 4, from which quenching water is sprayed on the mass of coke. The quenching car 2, quenching tower 4 and spray system 5 are of a conventional known kind.

An infra-red detector 6 is arranged above the track 1 of the quenching car just in front of the quenching tower. The angle of reception of the infra-red detector and the height at which it is located above the quenching car are such that it receives an image of a substantial part of the breadth of the load of coke in the car.

Figure 2:
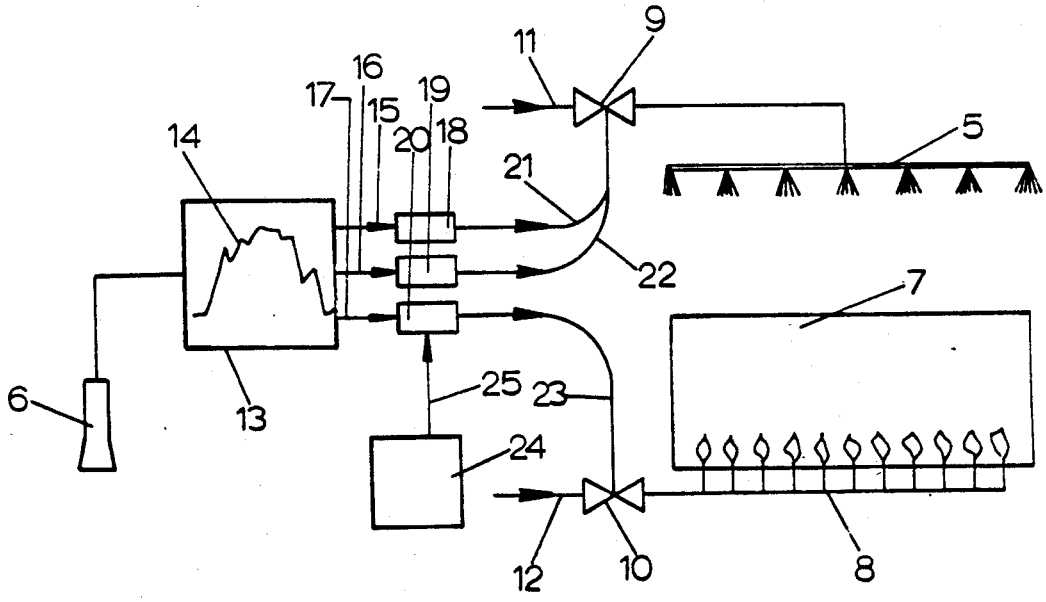
FIG. 2 is a block diagram showing the processing of the signal produced by the infra-red detector.

The control means which processes the signal received by the infra-red detector is shown diagrammatically in FIG. 2, which also diagrammatically shows a burner chamber 7 forming part of the coking battery. A set of burners 8 is shown beneath the chamber. It should be noted that in practice the number of burners varies from between 20 and 40. Each coking chamber is located between two such burner chambers 7 and is heated through the partition walls between the burner chambers and the coking chambers. Fuel is conveyed to the burners 8 via a duct 12 and a control valve 10. The Figure also shows the spray system 5 of quenching tower 4, again schematically with the supply line 11 for quenching water and the control valve 9 in this line 11.

The electrical signal 14 obtained from the infra-red detector 6 is processed by control apparatus indicated by a block 13 into three control signals 15, 16 and 17. Control signal 15 represents a sharp increase in the measurement signal 14 and is translated via a relay 18 into a command 21, which causes control valve 9 to be opened. This causes spray system 5 to operate, as the quenching car 2 continues to run under the detector 6. The control signal 16 is proportional to the maximum value of the measurement signal 14 and therefore to the maximum measured temperature of the coke 3 in the quenching car 2. The signal 16 is translated in means indicated by a block 19 into a quenching time, i.e. the desired duration of supply of water onto the coke, after which the valve 9 is again closed by the command 22. The greater the measured maximum temperature of the coke, the longer the quenching time employed. The control signal 17 is proportional to the average measurement signal 14, and is converted in means indicated by a block 20 into a control signal for the valve 10, so that with a high average measured temperature in the coke 3, the valve 10 is closed to a certain degree, to achieve a desired average temperature setting for the coke chamber walls.

The information from the signal 17 can also be combined in means indicated by a block 20 with information 25 obtained from a process computer 24, for processing into a control program for the temperature distribution in the burner chamber 7. Data can then also be entered into the process computer 24 on coking time, battery temperature and furnace charging.

It should be noted that the chambers in a coking battery are emptied in succession, so that the command 23 must be routed to a different control valve or a different burner chamber in each case.

As explained above, a further refinement of the system is possible where measurement signal 14 obtained as the car 2 passes the detector differs significantly from the standard pattern. This indicates that the temperature distribution along the quenching car and, consequently, usually over the whole of a coking chamber, is irregular. In this case, further commands can be obtained from the block 20, to set individual burners or groups of burners differently for each burner chamber to achieve different amounts of heat applied at different locations in the coking chamber.

It is also conceivable for the spray system 5 to be divided into sections, each being fed separately by a supply pipe 11 with a control valve 9. Various signals 22 can then be conveyed from the block 19 to each control valve 9 in such a way that the various spray sections in the tower are opened for differing periods, in dependence on the variation of the measurement signal from the detector as the car 2 passes the detector.

What is claimed is:

1. In a method for the production of coke, in which solid carbonaceous material is dry distilled in a coking chamber of a coke oven indirectly heated by heat applied to walls separating a coking chamber from an adjacent combustion chamber having a plurality of burners located therein at a plurality of different locations, the coke so produced is expelled into a quenching car and the quenching car is moved past an infra-red detector to a quenching station at which quenching water is distributed onto the coke, and wherein the infra-red detector is arranged to provide a signal when a quenching car carrying hot coke passes, which signal is used to determine the initiation of the supply of the quenching water, the improvement wherein: the detector is arranged to provide a measurement signal in dependence on the surface temperature of the coke in the quenching car, this signal being used to provide a first control signal which represents a sharp increase in said measurement signal and which initiates the supply of quenching water, a second control signal which is proportional to a maximum value of said measurement signal and which determines a desired duration of the supply of the quenching water and controls a means for discontinuing the supply of quenching water such that the greater the measured maximum value, the longer the quenching time employed, and at least a third control signal which is representative of variations in the measurement signal along the length of the quenching car as the car passes the detector from a standard pattern of coke surface temperature along the length of a quenching car and which determines desired amounts of heat to be applied to the walls at a plurality of different locations and which controls means for adjusting a supply of fuel to individual burners of said plurality of burners whereby the application of heat to the walls can be directly and individually controlled at the plurality of different locations.

2. The method according to claim 1 wherein variations in the measurement signal along the length of the quenching car as the car passes the detector from a standard pattern of coke surface temperature along the length of a quenching car are used by the second control signal to determine desired durations of quenching water supply at a plurality of different locations along the quenching car.

3. The method according to claim 1 wherein a value which is proporational to the average value of the measurement signal along the length of the quenching car as the car passes the detector is used by the third control signal to determine a desired average temperature setting for the walls.

* * * * *